US005678737A

United States Patent [19]

White

[11] Patent Number: 5,678,737

[45] Date of Patent: Oct. 21, 1997

[54] VENTED LIQUID DISPENSER AND ATTACHMENT CAP THEREFOR

[75] Inventor: Jonathan Z. White, Lynchburg, Va.

[73] Assignee: Prototype Development Corp., Lynchburg, Va.

[21] Appl. No.: 547,781

[22] Filed: Oct. 25, 1995

[51] Int. Cl.[6] ..... F04F 10/00

[52] U.S. Cl. ..... 222/484; 222/501; 222/567; 285/354

[58] Field of Search ..... 222/481, 484, 222/501, 506, 509, 518, 567; 285/331, 354, 386

[56] References Cited

U.S. PATENT DOCUMENTS

| | | | |
|---|---|---|---|
| 2,756,910 | 7/1956 | Snyder | 222/484 |
| 4,375,864 | 3/1983 | Savage | 222/501 X |
| 4,380,310 | 4/1983 | Schneiter et al. | 222/501 |
| 5,332,127 | 7/1994 | White | 222/484 X |

FOREIGN PATENT DOCUMENTS

| | | | |
|---|---|---|---|
| 2634750 | 2/1990 | France | 222/484 |
| 3731820 | 4/1989 | Germany | 222/484 |
| 2129080 | 5/1984 | United Kingdom | 285/81 |

*Primary Examiner*—Kevin P. Shaver
*Attorney, Agent, or Firm*—Sughrue, Mion, Zinn, Macpeak & Seas, PLLC

[57] ABSTRACT

A vented liquid dispenser with a gravity feed of liquid from an inverted bottle includes a cup-shaped body having a center tube extending through an opening in the bottom of the cup-shaped body. A hollow tubular valve member is slidably mounted on the tube and a washer is secured to the lower end of the valve member in sliding sealing engagement with the tube and movable into and out of engagement with a seat surrounding the opening in the cup-shaped body. A lifter extending axially through the valve body has a vent closure at one end engageable with the valve member to seal the valve member with the opposite end engaged by a pivoted handle on the cup-shaped body. A single spring is connected between the lifter, the valve member and the tube for controlling the closing of the vent closure and the closing of the opening in the cup-shaped body. A probe may be attached to the cup-shaped body for penetrating a cap and removably holding a plug from the cap during dispensing with the plug being automatically replaced in the cap upon withdrawal of the probe. Alternatively, the cup-shaped body may be provided with a threaded compression nut having inwardly and axially directed fingers thereon for engaging a lip of the bottle to hold the vented liquid dispenser on the mouth of the bottle.

9 Claims, 2 Drawing Sheets

VENTED LIQUID DISPENSER AND ATTACHMENT CAP THEREFOR

BACKGROUND OF THE INVENTION

The present invention relates to a vented liquid dispenser for large bottles and more specifically to a vented liquid dispenser associated with a probe for penetrating a cap secured to a bottle and removing a plug from the cap. Upon withdrawal of the probe, the plug is automatically reattached to the cap. Additionally, the present invention is directed to an improved valve arrangement utilizing a single spring for biasing a lifter secured to a vent closure and for biasing a tubular valve member having a flexible washer for controlling the flow of water.

Conventional water bottles are generally provided with a cap of plastic material tightly fitted over an enlarged lip about the mouth of the bottle neck and provided with a tear strip to facilitate removal of the cap. Various dispensing systems are used, including coolers where the bottle is inverted subsequent to removing the sealed cap and immersing the bottle opening in a reservoir in the cooler. Atmospheric pressure on the open reservoir surface balances a vacuum above water in the bottle and prevents overflow. Faucets of various designs are used to dispense water from the reservoir. Since the cap is essentially destroyed in removing the cap from the mouth of the bottle, it is practically impossible to reattach the cap to the bottle after the bottle is empty to prevent undue contamination of the interior of the bottle. Even if a re-attachable cap is provided for the bottle, the user frequently fails to reattach the cap to the bottle, which leads to excessive contamination of the interior of the bottle.

The U.S. Patent to White (U.S. Pat. No. 5,332,127) discloses several embodiments of vented liquid dispensers for a liquid contained in a closed container. A complicated clamping arrangement is necessary which includes a beveled skirt, a split compression ring and a nut to sealingly attach the dispenser to the container. A dispenser is provided with a tubular valve member having a sealing arrangement at the lower end thereof which cooperates with a main cap portion of the dispenser for controlling the flow of water. A vent closure is provided at the upper end of the hollow tubular valve member which is secured to a lifter extending downwardly through the hollow tubular valve member for engagement with a pivoted operating handle. In several embodiments, a single resilient device is provided for biasing the vent closure toward the closed position, which in turn then applies a force to the tubular valve member for cutting off the flow of water. In another embodiment, positive control is maintained of the relative position and rate of motion of the valve member and the vent closure by means of two springs for exerting a closing force between the valve member and a primary sealing surface and for exerting a closing force between the vent closure and the valve member. Such a double spring arrangement is cumbersome and expensive to manufacture and install.

SUMMARY OF THE INVENTION

The present invention is directed to a new and improved vented liquid dispenser and attachment cap therefor, wherein a probe is secured to the attachment cap for penetrating a cap secured to the neck of a bottle, said cap having an inwardly extending center tube closed by a plug detachably secured to the innermost end thereof and adapted to be engaged by an end of said probe, whereby upon penetration of the probe through the center tube of the cap, the end of the probe will engage the plug and remove the plug from the center tube of the cap to establish flow of water through at least one slot formed in the side wall of said probe which extends beyond the center tube of the cap. The vented liquid dispenser connected to the probe dispenses liquid from the bottle by gravity when the bottle is inverted.

The present invention is directed to a new and improved vented liquid dispenser and attachment means for securing the dispenser to an enlarged bottle mouth comprising a valve body having an axially extending flange with external threads thereon, a sealing ring mounted in said valve body in engagement with an internal surface of said flange and a compression nut having threads engageable with the threads on the flange and a plurality of flexible inwardly directed fingers at one end thereof which extend inwardly of the flange when the compression nut is mounted thereon, whereby the enlarged mouth of the body will be gripped between the sealing ring and the fingers to secure the dispenser on the bottle.

The present invention is directed to a new and improved vented liquid dispenser comprising a cup-shaped valve body having an opening in a bottom surface thereof, a center tube connected to said valve body and extending through said opening both inwardly and outwardly of the valve body, a tubular valve member slidably mounted on the center tube, a lifter having a vent closure at one end thereof extending through said tubular valve body for moving said vent closure into and out of sealing engagement with an upper end of said tubular valve member, a pivoted handle mounted on said valve body and engaging a lower end of said lifter, a flexible washer mounted on a lower end of said tubular valve member and sealingly engaging said center tube and adapted to sealingly engage said valve body to close the opening in the bottom of the cup-shaped valve body and spring means disposed within said center tube and said tubular valve member in operative engagement with said lifter, said tubular valve member and said center tube for normally biasing said vent closure into engagement with said tubular valve member and said flexible washer on said tubular valve member into sealing engagement with said valve body.

The above and other objects, features and advantages of the present invention will be more apparent and more readily appreciated from the following detailed description of preferred exemplary embodiment of the present invention, taken in connection with the accompanying drawings.

DETAILED DESCRIPTION OF THE INVENTION

Figure 1:
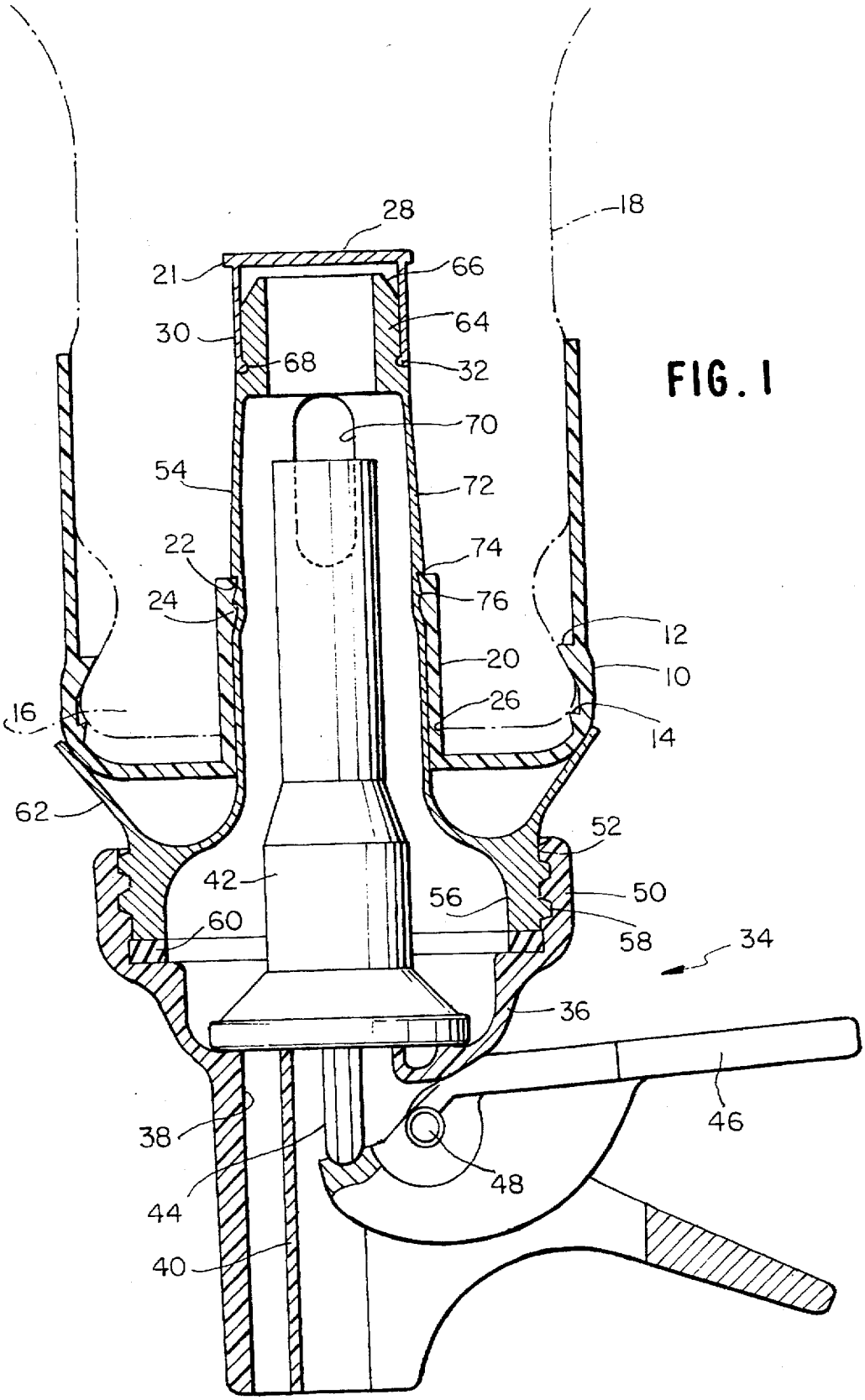
FIG. 1 is a partial, vertical, sectional view of a vented liquid dispenser with a probe thereon extending through a center tube for a bottle cap in an operative condition.

The dispenser arrangement shown in FIG. 1 is used in conjunction with a cap on a water bottle which does not have to be removed from the water bottle and which is provided with a center plug which is automatically removed and reattached upon insertion and withdrawal, respectively, of a probe attached to the dispenser.

The safety cap 10 is comprised of a flexible material such as plastic or the like having a pair of inwardly extending annular flanges 12 and 14 which are adapted to sealingly engage an enlarged lip 16 on the neck of a bottle 18. The cap 10 is provided with an inwardly extending center tube 20 having a pair of annular inwardly extending sealing flanges 22 and 24 adjacent the end thereof. The center tube 20 is designed to have a sealing engagement with the mouth 26 of the bottle 18. A closure plug 28 is provided with an annular flange 30 and an annular inwardly extending lip 32 at the lower end thereof. The plug 28 is designed to be disposed in tight sealing engagement with the center tube 20 due to the tight sealing engagement of the annular flanges 22 and 24 with the outer surface of the flange 30 on the plug 28.

A dispenser 34 is comprised of a cup-shaped valve body 36 of plastic or other suitable material which is provided with a central opening 38 in the bottom surface thereof. A valve center tube 40 is integral with the valve body 36 and extends through the opening 38 in both directions. A tubular valve member 42 is mounted on the valve center tube and a valve lifter 44 extending downwardly from the valve 42 is engaged with an operating handle 46 pivotally mounted at 48 on a valve body. The details of the construction and operation of the dispenser will be described hereinafter.

The cup-shaped valve body 36 is provided with an annular flange 50 having internal threads 52. A hollow, substantially tubular probe 54 is provided with a base portion 56 having external threads 58 thereon, which engage the threads 52 on the flange 50 of the valve body 36. A sealing ring 60 of a suitable elastomeric material is interposed between the end of the base 56 and the valve body 36. A flexible flange 62 extends upwardly and outwardly from the base 56 to compressively contact the outer surface of the cap to stabilize the valve body and to improve the appearance of the final assembly.

The upper end of the probe 54 is provided with a reduced diameter tip 64 having a bevelled end surface 66 and an annular groove 68 adjacent the base of the tip. The probe is provided with a plurality of axially extending slots 70 in the side wall 72 of the probe 54. The side wall 72 of the probe 54 is also provided with a pair of annular flanges 74 and 76 which are complementary to and engage frictionally the flanges 22 and 24 on the cap center tube 20 when the probe is inserted a desired distance into the neck of the bottle 18. The snapping of the flanges into complementary engagement identifies the desired position for the probe so that the slots 70 will be fully exposed beyond the innermost end of the cap center tube 20.

In order to mount the dispenser 34 on the bottle 18 having the safety cap 10 thereon, it is only necessary to screw the probe 54 into the valve body 36 and insert the probe through the cap center tube 20. The tip 64 of the probe will be guided into the flange 30 of the plug 28 by means of the bevelled edge 66 until the rib 32 snaps into the slot 68 at the base of the tip. Continued movement of the probe into the neck of the bottle will force the plug 28 out on engagement with the cap center tube 20 into the operative position shown in FIG. 1. When the bottle is empty, it is only necessary to pull the probe outwardly of the cap, whereupon the plug will be reinserted into the cap center tube 20 until the flange 21 of the plug engages the innermost end of the tube 20, whereupon the tip will become detached from the flange 30 of the plug. Thus the cap will be automatically closed to provide a protected sealed environment within the bottle 18.

Figure 2:
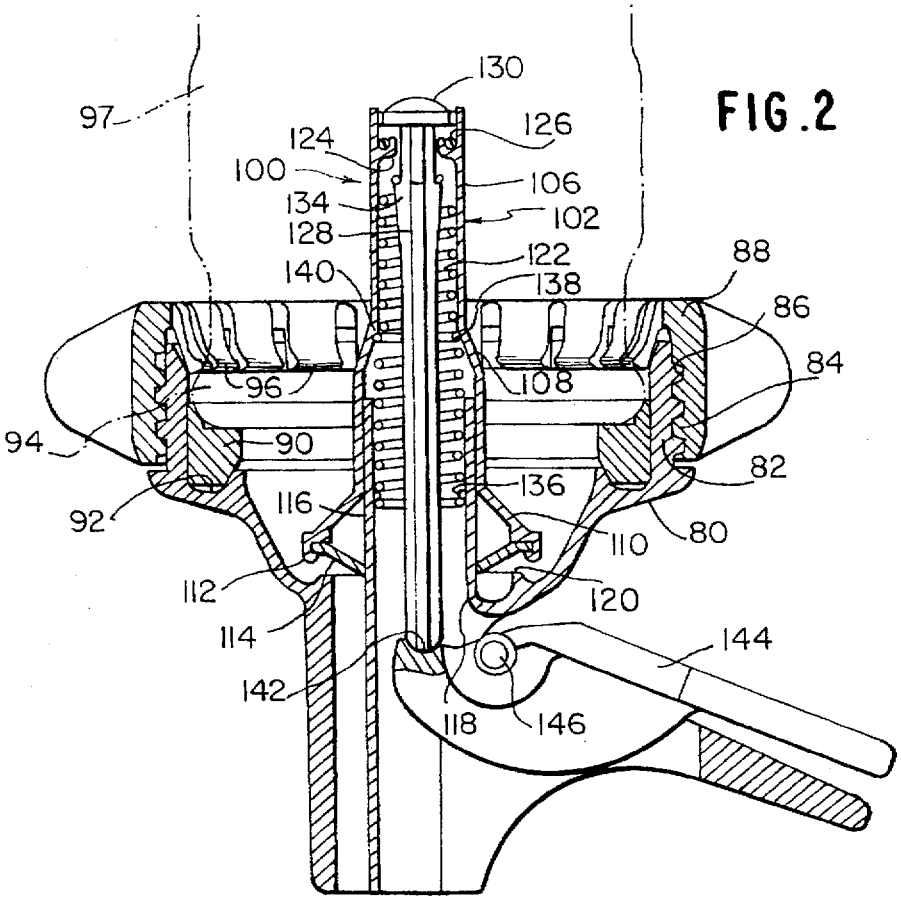
FIG. 2 is a partial, sectional view of a vented liquid dispenser according to the present invention with a compression nut assembled thereto for securing the dispenser to the mouth of a bottle.

The construction of the dispenser 34 is shown in FIG. 2 with the exception of the flange on the valve body and the compression nut which cooperates with the flange. The valve body 80, as shown in FIG. 2, differs from the valve body 36 as shown in FIG. 1, in that the flange 82 is provided with external threads 84 which are engageable with the internal threads 86 on a compression nut 88.

A sealing ring 90 is disposed in a groove 92 inwardly of the flange 82 for engagement with the lip 94 on the neck of a bottle 96. The flange 82 of the valve body is adapted to extend completely over the lip 94 of the bottle 96.

The compression nut 88 is provided with a plurality of flexible inwardly and downwardly extending fingers 96 which are of integral one-piece construction with the nut and which are equally spaced about the entire periphery of the compression nut 88. The compression nut may be constructed of plastic or any other suitable material which would enable the fingers 96 to be flexible. The flexible fingers are adapted to engage the underside of the lip 94 of the bottle 96.

In order to mount the valve body of the dispenser on the neck of the bottle, the compression nut 88 is partially unscrewed from the flange against a stop to provide clearance between the seal 90 and the fingers 96 for receiving the lip 94 of the bottle. After pressing the nut 88 over the lip 94, the nut is rotated to clamp the lip 94 between the fingers 96 and the seal 90.

This will securely mount the dispensing assembly on the mouth of the bottle in a sealed manner for the gravity dispensing of a liquid from the bottle in an inverted position.

Figure 3:
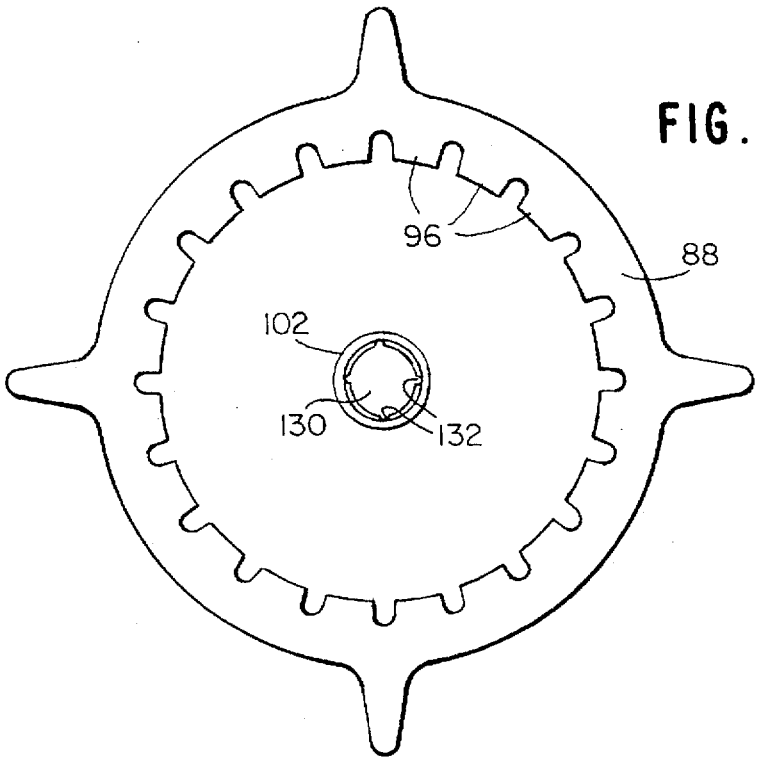
FIG. 3 is a plan view of the upper end of the assembly shown in FIG. 2.

The valve mechanism 100 is comprised of a hollow, tubular valve member 102 having a large diameter central portion 104 and a small diameter upper end portion 106 interconnected by means of a tapered portion 108. A truncated, conical end portion 110 is formed on the lower end of the large diameter portion 104 and is provided with a lip 112 which may be crimped over the outer circumference of a flexible washer 114 to secure the washer to the tubular valve member 102. The inner circumference of the flexible washer 114 is disposed in slidable sealing engagement with a valve center tube 116 which extends through the opening 118 in the bottom of the valve body 80. The large diameter portion 104 of the tubular valve member is disposed over the innermost end of the valve center tube 116 in sliding engagement therewith. The valve body 80 is provided with an annular valve seat 120 which is engageable by the washer 114 when the valve member 102 is moved downwardly under the influence of the spring 122 disposed in the valve member 104. The upper end of the valve member 102 is provided with an inwardly extending annular flange 124 which supports an annular sealing ring 126 in spaced relation from the open, upper end of the valve member 102. An elongated valve lifter 128 extends the length of the tubular valve member 102 and a vent closure 130 is secured to the upper end thereof for sealing engagement with the sealing ring 126 to prevent the flow of liquid or air when the vent closure 130 is in a closed position. The vent closure 130 is provided with four radially outwardly extending projections 132 which slidably engage the interior surface of the tubular valve member 102 as best seen in FIG. 3. The projections 132 act as guides for the lifter and the sector-shaped openings between the projections allow for the flow of air past the vent closure 130 when the vent closure is in the open position as shown in FIG. 2. The vent which is controlled by the vent closure 130 is located above and upstream of the liquid outlet opening as shown in FIG. 2.

The spring 122 within the valve member 102 surrounds the lifter 128 with the upper end thereof engaging the upper surface of outwardly extending barbs 134 on the lifter 128. The lower end of the coil spring 122 engages a plurality of barbs 136 extending inwardly from the internal surface of the valve center tube 116. The center coil 138 of the spring 122 engages an internal annular flange 140 on the valve member 102 adjacent the end of the small diameter portion 106 connected to the tapered portion 108. The spring 122 is provided with a small diameter portion above the center coil 138 and a large diameter portion below the center coil 138. The upper small diameter portion of the spring 122 biases the vent closure 130 downwardly toward the closed position in engagement with the sealing ring 126. Subsequently, the lower, larger diameter portion of the spring biases the tubular valve member downwardly by means of the lifter 128 and vent closure 130 to move the washer 114 toward sealing engagement with the valve seat 120. Additionally, one or more barbs may be formed on the valve member 102 in engagement with the center coil 138 opposite the flange 140 to effectively secure the center coil 138 to the valve member. With this arrangement, the lower portion of the spring acts directly on the valve member 102.

The lower end of the lifter 128 is engaged in a recess 142 in an operating lever 144 pivotally mounted on the valve body 80 by means of a pivot 146.

The use of a single extension spring eliminates the need for two compression springs as in the prior art discussed above as well as the need for a support post which is required for the use of two compression springs. Thus, it is possible to obtain a maximum, open, cross-sectional area within the tubular valve member 102 to minimize the pressure drop in the returning air stream. The effect of pressure drop in the air stream is to reduce the water flow rate.

Most, if not all of the parts of the dispenser may be of molded plastic material with the sealing rings and valve washers being constructed of rubber or other suitable elastomeric materials. As mentioned previously, the dispenser device as disclosed in FIG. 2 can be used as the dispenser device in the embodiment of FIG. 1. Thus, the dispenser device as disclosed, is usable either in the situation where a cap is completely removed from the bottle and the dispenser is secured to the mouth of the bottle by means of the compression nut in FIG. 2 or when a safety cap is provided for the bottle and a probe is used in conjunction with the dispenser as shown in FIG. 1.

While the invention has been particularly shown and described with reference to preferred embodiments thereof, it will be understood by those in the art that the foregoing and other changes in form and details may be made therein without departing from the spirit and scope of the invention.

What is claimed is:

1. A vented liquid dispenser comprising in combination a cap adapted to be sealingly connected to the neck of a bottle, said cap having a hollow, tubular projection adapted to extend into the neck of the bottle with a plug detachably connected to an innermost end of the hollow tubular projection and a probe connected to the vented liquid dispenser, said probe comprising attachment means for detachably mounting said probe on said vented liquid dispenser, an elongated, hollow, substantially tubular probe member connected to said attachment means and adapted to extend into the neck of the bottle through the hollow tubular protection of the cap and tip means on said probe member engageable with said plug for removing said plug from said cap upon insertion of said probe member through said hollow tubular projection, said hollow, tubular probe member having at least one opening extending therethrough and located between said tip means and said hollow tubular projection upon insertion of said probe member through said hollow tubular projection of the cap, wherein said dispenser is comprised of a cup-shaped valve body having an opening in a bottom surface thereof, a center tube connected to said cup-shaped valve body and extending through said opening both inwardly and outwardly of the cup-shaped valve body, a tubular valve body slidably mounted on the center tube, within said tubular probe member and having an upper end disposed adjacent said at least one opening in said tubular probe member, a lifter having a vent closure at one end thereof extending through said tubular valve body for moving said vent closure into and out of sealing engagement with an upper end of said tubular valve body, a handle pivotally mounted on said cup-shaped valve body and engaging a lower end of said lifter.

2. A vented liquid dispenser as set forth in claim 1, wherein said plug is provided with an annular flange for engaging said hollow tubular projection upon withdrawal of said probe to permit withdrawal of the tip of said probe member when said plug is reinserted in said hollow tubular projection.

3. A vented liquid dispenser as set forth in claim 1, further comprising a flexible washer mounted on a lower end of said tubular valve member and sealingly engaging said center tube and sealingly engaging said cup-shaped valve body to close said opening in the bottom of the cup-shaped valve body and spring means disposed within said center tube and said tubular valve member in operative engagement with said lifter, said tubular valve member and said center tube for biasing said vent closure into engagement with said tubular valve member and said flexible washer on said tubular valve member into sealing engagement with said cup-shaped valve body.

4. A vented liquid dispenser as set forth in claim 3, wherein said tubular valve body is comprised of a large diameter central portion, a small diameter upper end portion connected to said large diameter central portion by a tapered portion and a truncated, conical end portion connected to the lower end of the large diameter portion and engaging means for engaging an outer circumferential edge of said flexible washer with the truncated conical end portion and wherein said spring means is comprised of a single spring surrounding said lifter, first spring retaining means on said lifter for engaging an upper end of said spring, second spring retaining means on an internal surface of the center tube for engaging a lower end of said spring and a center coil of said spring engaging an internal annular flange on the tubular valve member adjacent the end of the tapered portion connected to the small diameter portion.

5. A vented liquid dispenser as set forth in claim 4, further comprising additional spring retaining means on said tapered portion opposed to said internal annular flange for engaging said center coil therebetween.

6. A vented liquid dispenser comprising a cup-shaped valve body having valve means therein and means for operating said valve means, said cup-shaped valve body having an externally threaded axially extending flange, an internally threaded compression nut threadingly engaging said externally threaded flange member, annular sealing means disposed inwardly of said externally threaded axially directed flange for engaging an end surface of an enlarged lip surrounding an opening in a bottle neck, wherein said compression nut is provided with a plurality of flexible inwardly and axially directed fingers of integral one-piece construction with said compression nut and extending within said externally threaded annular flange of said cup-shaped valve body upon threading said compression nut thereon to bring ends of said fingers into gripping engagement with said lip opposite said sealing ring.

7. A vented liquid dispenser as adapted to be mounted in a neck of an inverted bottle for the gravity dispensing of liquid in the bottle, said dispenser comprising a cup-shaped valve body having an opening in a bottom surface thereof, a center tube connected to said valve body and extending through said opening both inwardly and outwardly of the valve body, a tubular valve member slidably mounted on the center tube, a lifter having a vent closure at one end thereof extending through said tubular valve member for moving said vent closure into and out of sealing engagement with an upper end of said tubular valve member, a handle pivotally mounted on said cup-shaped valve body and engaging a lower end of said lifter, a flexible washer mounted on a lower end of said tubular valve member and sealingly engaging said center tube and sealingly engaging said valve body to close said opening in the bottom of the cup-shaped valve body and spring means disposed within said center tube and said tubular valve member in operative engagement with said lifter, said tubular valve member and said center tube for biasing said vent closure into engagement with said tubular valve member and said flexible washer on said tubular valve member into sealing engagement with said valve body.

8. A vented liquid dispenser as set forth in claim 7, wherein said tubular valve body is comprised of a large diameter central portion, a small diameter upper end portion connected to said large diameter central portion by a tapered portion and a truncated, conical end portion connected to the lower end of the large diameter portion and engaging means for engaging an outer circumferential edge of said flexible washer with the truncated conical end portion and wherein said spring means is comprised of a single spring surrounding said lifter, first spring retaining means on said lifter for engaging an upper end of said spring, second spring retaining means on an internal surface of the center tube for engaging a lower end of said spring and a center coil of said spring engaging an internal annular flange on the cup-shaped valve member adjacent the end of the tapered portion connected to the small diameter portion.

9. A vented liquid dispenser as set forth in claim 8, further comprising additional spring retaining means on said tapered portion opposed to said internal annular flange for engaging said center coil therebetween.

* * * * *